US009822985B2

(12) United States Patent
King

(10) Patent No.: US 9,822,985 B2
(45) Date of Patent: Nov. 21, 2017

(54) RADIANT HEATING SYSTEM

(71) Applicant: DYNACURRENT TECHNOLOGIES, INC., Ontario (CA)

(72) Inventor: Ray King, Ontario (CA)

(73) Assignee: DYNACURRENT TECHNOLOGIES, INC. (CA)

( * ) Notice: Subject to any disclaimer, the term of this patent is extended or adjusted under 35 U.S.C. 154(b) by 543 days.

(21) Appl. No.: 13/666,537

(22) Filed: Nov. 1, 2012

(65) Prior Publication Data

US 2014/0117002 A1 May 1, 2014

(51) Int. Cl.

| | |
|---|---|
| ***H05B 3/02*** | (2006.01) |
| ***F24H 9/00*** | (2006.01) |
| ***F24D 3/00*** | (2006.01) |
| ***F24H 1/10*** | (2006.01) |
| ***F24H 9/18*** | (2006.01) |
| *F24H 1/22* | (2006.01) |

(52) U.S. Cl.

CPC ..... *F24D 3/00* (2013.01); *F24H 1/102* (2013.01); *F24H 9/0015* (2013.01); *F24H 9/0021* (2013.01); *F24H 9/1818* (2013.01); *F24D 2200/08* (2013.01); *F24D 2220/0207* (2013.01); *F24H 1/225* (2013.01)

(58) Field of Classification Search

CPC ... F24H 1/121; F24H 1/103; H05B 2203/021; H05B 3/06

USPC ..... 219/201, 202, 205, 208; 392/451, 487, 392/311, 314

See application file for complete search history.

(56) References Cited

U.S. PATENT DOCUMENTS

| | | | |
|---|---|---|---|
| 1,458,666 | A | 3/1924 | Coldwell |
| 1,485,667 | A | 3/1924 | Coldwell |
| 1,505,179 | A | 8/1924 | Whiteley |
| 1,509,207 | A | 9/1924 | Hudson |

(Continued)

FOREIGN PATENT DOCUMENTS

| | | |
|---|---|---|
| CA | 2017503 | 11/1990 |
| CA | 2551341 | 12/2007 |

(Continued)

OTHER PUBLICATIONS

U.S. Office Action for U.S. Appl. No. 12/557,682, dated Jun. 19, 2013; 14 pages.

(Continued)

*Primary Examiner* — Quang D Thanh
*Assistant Examiner* — Lawrence Samuels
(74) *Attorney, Agent, or Firm* — Schmeiser, Olsen & Watts, LLP

(57) ABSTRACT

A radiant heating system includes a housing and a plurality of heating elements. The housing includes a top cover configured to cover and seal an upper surface of the housing and a coolant directing enclosure positioned on an upper interior surface of the top cover. The top cover includes a plurality of openings, an inlet configured to allow a coolant to enter into the housing and an outlet configured to allow the coolant to exit the housing. The plurality of heating elements are configured to be inserted into the plurality of openings of the top cover such that the plurality of heating elements project into the housing and contact a coolant. A diameter of the inlet is greater than a diameter of the outlet.

9 Claims, 8 Drawing Sheets

(56) References Cited

U.S. PATENT DOCUMENTS

| | | | | |
|---|---|---|---|---|
| 1,546,959 | A | 7/1925 | Wilson | |
| 1,759,389 | A | 5/1930 | Bowen | |
| 1,850,156 | A | 3/1932 | Richarson | |
| 2,205,145 | A | 6/1940 | Klingner | |
| 2,266,216 | A | 12/1941 | Kimberlin | |
| 2,557,369 | A | 6/1951 | Broderick | |
| 2,745,941 | A | 5/1956 | McElhaney | |
| 2,825,791 | A | 3/1958 | Jackson | |
| 2,834,865 | A | 5/1958 | Coates | |
| 3,171,016 | A | 2/1965 | Sukala | |
| 3,209,123 | A | 9/1965 | Windsor | |
| 3,280,299 | A * | 10/1966 | Doniak | 392/490 |
| 3,353,000 | A | 11/1967 | Tomlinson | |
| 3,435,404 | A | 3/1969 | Kato | |
| 3,446,940 | A * | 5/1969 | Morgan | F24H 9/1818 165/82 |
| 3,483,357 | A * | 12/1969 | Cunningham | F24H 1/225 165/132 |
| 3,484,580 | A | 12/1969 | Morgan | |
| 3,496,991 | A | 2/1970 | Barnd | |
| 3,626,148 | A | 12/1971 | Woytowich et al. | |
| 3,646,314 | A | 2/1972 | Windsor | |
| 3,673,385 | A * | 6/1972 | Drugmand | F24H 9/1818 219/523 |
| 3,868,494 | A * | 2/1975 | Pepin | F24D 3/02 126/101 |
| 3,919,520 | A | 11/1975 | Pickard | |
| 3,969,605 | A | 7/1976 | Danell | |
| 4,208,570 | A | 6/1980 | Rynard | |
| 4,245,593 | A | 1/1981 | Stein | |
| 4,286,139 | A | 8/1981 | Taylor | |
| 4,309,592 | A * | 1/1982 | Le Boeuf | 392/470 |
| 4,419,567 | A | 12/1983 | Murphy et al. | |
| 4,489,242 | A | 12/1984 | Worst | |
| 4,692,592 | A | 9/1987 | Kale | |
| 4,732,229 | A | 3/1988 | Lucht | |
| 4,770,134 | A | 9/1988 | Foreman et al. | |
| 4,808,793 | A * | 2/1989 | Hurko | F24H 1/102 392/480 |
| 5,216,743 | A * | 6/1993 | Seitz | F24H 1/102 219/497 |
| 5,285,963 | A | 2/1994 | Wakefield et al. | |
| 5,408,960 | A | 4/1995 | Woytowich | |
| 5,438,642 | A * | 8/1995 | Posen | F24H 1/102 122/19.1 |
| 5,809,941 | A * | 9/1998 | Allaire | F24H 1/103 392/452 |
| 6,157,776 | A | 12/2000 | Onken | |
| 6,215,310 | B1 | 4/2001 | Petrovich et al. | |
| 6,289,177 | B1 * | 9/2001 | Finger et al. | 392/485 |
| 6,647,204 | B1 * | 11/2003 | Hutchinson | A47L 11/34 15/320 |
| 7,082,904 | B2 | 8/2006 | Takano | |
| 7,207,379 | B2 | 4/2007 | Takano et al. | |
| 7,330,645 | B2 | 2/2008 | Kwon | |
| 2002/0146244 | A1 | 10/2002 | Thweatt, Jr. | |
| 2003/0026603 | A1 * | 2/2003 | Castaneda et al. | 392/483 |
| 2003/0039474 | A1 | 2/2003 | Eller et al. | |
| 2004/0022529 | A1 | 2/2004 | Lamb | |
| 2004/0170411 | A1 | 9/2004 | Kuebler et al. | |
| 2006/0163235 | A1 | 7/2006 | Warren et al. | |
| 2008/0083737 | A1 | 4/2008 | Vu | |
| 2008/0156285 | A1 | 7/2008 | King | |
| 2009/0107974 | A1 * | 4/2009 | Testa | 219/208 |
| 2009/0139472 | A1 | 6/2009 | Gehres et al. | |
| 2010/0021148 | A1 * | 1/2010 | Theilacker-beck et al. | 392/443 |
| 2010/0034528 | A1 * | 2/2010 | Willis et al. | 392/451 |
| 2010/0059599 | A1 | 3/2010 | King | |
| 2010/0206872 | A1 * | 8/2010 | Matsuzawa et al. | 219/687 |
| 2010/0239236 | A1 * | 9/2010 | Anliker | A47J 31/54 392/497 |
| 2011/0116776 | A1 * | 5/2011 | Wheeler | F24H 1/121 392/441 |
| 2012/0223065 | A1 | 9/2012 | King | |
| 2012/0224836 | A1 | 9/2012 | King | |
| 2013/0016959 | A1 | 1/2013 | King | |
| 2014/0117002 | A1 * | 5/2014 | King | 219/201 |

FOREIGN PATENT DOCUMENTS

| | | |
|---|---|---|
| CA | 2668817 | 12/2010 |
| JP | 57-173558 | 10/1982 |
| KR | 10-2004-0001394 A | 1/2004 |
| KR | 10-2004-0001395 A | 1/2004 |
| KR | 10-2004-0061534 A | 7/2004 |
| WO | WO-2008/000076 A1 | 1/2008 |

OTHER PUBLICATIONS

U.S. Office Action for U.S. Appl. No. 13/064,075, dated Jul. 23, 2013; 8 pages.

U.S. Office Action for U.S. Appl. No. 12/457,397, dated Jul. 30, 2013; 22 pages.

U.S. Appl. No. 12/457,397, filed Jun. 10, 2009, King, Ray.

International Preliminary Report on Patentability; PCT/CA2007/001145; 3 pages; dated Oct. 30, 2008.

Written Opinion of the International Searching Authority; PCT/CA2007/001145; 5 pages; dated Oct. 5, 2007.

"Glow Plugs as Cooling Water Pre-Heater in Modern Diesel Cars (Type GN)"; BERU AG, Nov. 5, 2002. Archive.org Apr. 22, 2008, <http://web.archive.org/web/20021115200353/http://www.beru.com/english/produkte/gluehkerzen/gn.php>.

"Internet Archive Wayback Machine." Archive.org Apr. 11, 2008. <http://web.archive.org/web/*/http://www.beru.com/english/produkte/gluehkerzen/gn.php>.

* cited by examiner

RADIANT HEATING SYSTEM

CROSS-REFERENCE TO RELATED PATENT APPLICATIONS

This application claims priority from Canadian Application 2,793,130, entitled, RADIANT HEATING SYSTEM AND TURBULENCE CREATING BOILER HOUSING FOR USE THEREIN and filed, Oct. 17, 2012. This application is incorporated herein by reference in its entirety.

BACKGROUND

The present application relates generally to the field of radiant heating systems. More specifically, the application relates to a radiant heating system and to an improved turbulence creating housing for use in a radiant heating system.

It is well known that, for example, furnaces can be used to heat spaces such as homes. Traditionally, such furnaces were oil furnaces. However, as the demand for oil has risen sharply in the last decade, the price for oil has correspondingly risen sharply, reducing the ability of such furnaces to be economical to a home or business owner. Recently, gas-fired applications that utilize natural gas have been used by homeowners to economically heat their homes. However, similar to oil, natural gas has also seen large price increases in the last couple of years, which has resulted in the reduced economic viability of gas-fired applications.

It is also well known to heat homes or spaces using, for example, electrical baseboards. However, as hydro rates have risen quite sharply recently, and can be expected to rise in the future, these types of devices are also necessarily economically viable. In addition, heating systems such as furnaces can require a large footprint and take up a large amount of space.

In addition, certain types of heating arrangements have utilized internally positioned electrical elements configured to heat coolant by an electrical element. U.S. Pat. Nos. 5,408,960 (Woytowich) and 4,770,134 (Foreman et al) are examples of such devices. However, these arrangements feature electrical elements that are internally positioned and firmly set within a tank or chamber such that the electrical elements cannot be easily removed from the pre-heater without complete disassembly or destruction of the heating arrangement. In such configurations, when maintenance or replacement of the electrical elements is required, it is necessary to remove the entire heating unit to access the internal electrical element. Thus, maintenance and replacement of the internally positioned electrical elements for such heating arrangements is difficult and complicated.

A need exists for a radiant heating system that is economical and capable of generating substantial amounts of heat to heat larger spaces, such as in a home or business. In addition, there is a need for a radiant heating system which possesses a minimal footprint. Further there is a need for a radiant heating system which can be utilized in a variety of applications, from heating a home to radiant floor heating. The embodiments of the present invention substantially fulfill these needs.

SUMMARY

One disclosed embodiment relates to a radiant heating system including a housing and a plurality of heating elements. The housing includes a top cover configured to cover and seal an upper surface of the housing and a coolant directing enclosure positioned on an upper interior surface of the top cover. The top cover includes a plurality of openings, an inlet configured to allow a coolant to enter into the housing and an outlet configured to allow the coolant to exit the housing. The plurality of heating elements are configured to be inserted into the plurality of openings of the top cover such that the plurality of heating elements project into the housing and contact a coolant. A diameter of the inlet is greater than a diameter of the outlet.

Another disclosed embodiment relates to a housing for use in a radiant heating system including a top cover, a coolant directing enclosure, a plurality of openings, an inlet and an outlet. The top cover is configured to cover and seal an upper surface of the housing. The coolant directing enclosure is positioned on an upper interior surface of the top cover. The plurality of openings are configured to receive a plurality of heating elements such that the plurality of heating elements project into the housing and contact a coolant. The inlet is configured to allow a coolant to enter into the housing. The outlet is configured to allow the coolant to exit the housing. A diameter of the inlet is greater than a diameter of the outlet.

BRIEF DESCRIPTION OF THE DRAWINGS

The accompanying drawings, which are incorporated in and constitute a part of this specification, illustrate preferred embodiments of the invention and together with the description serve to explain principles of the invention.

DETAILED DESCRIPTION

Referring to FIGS. 1-4, a radiant heating system and an improved turbulence creating housing for use in a radiant heating system, which is economical and capable of generating substantial amounts of heat to heat larger spaces, such as in a home or business is provided. The radiant heating system and turbulence creating housing are environmentally friendly and have a generally uncomplicated and simple design, which is durable, reliable and easily installed. The radiant heating system and turbulence creating housing include easily removable or replaceable heating elements. An internally positioned coolant directing enclosure on an upper interior surface of a top cover of the turbulence creating housing is configured to increase the turbulence of the coolant flowing within the housing, so as to temporarily inhibit flow and keep coolant in the housing longer to heat it in a faster and more efficient manner, and increase water pressure in the system. The embodiments of the radiant heating system and the turbulence creating housing, which can be utilized in a variety of applications, from heating a home to radiant floor heating, will be described in further detail below.

Figure 1:
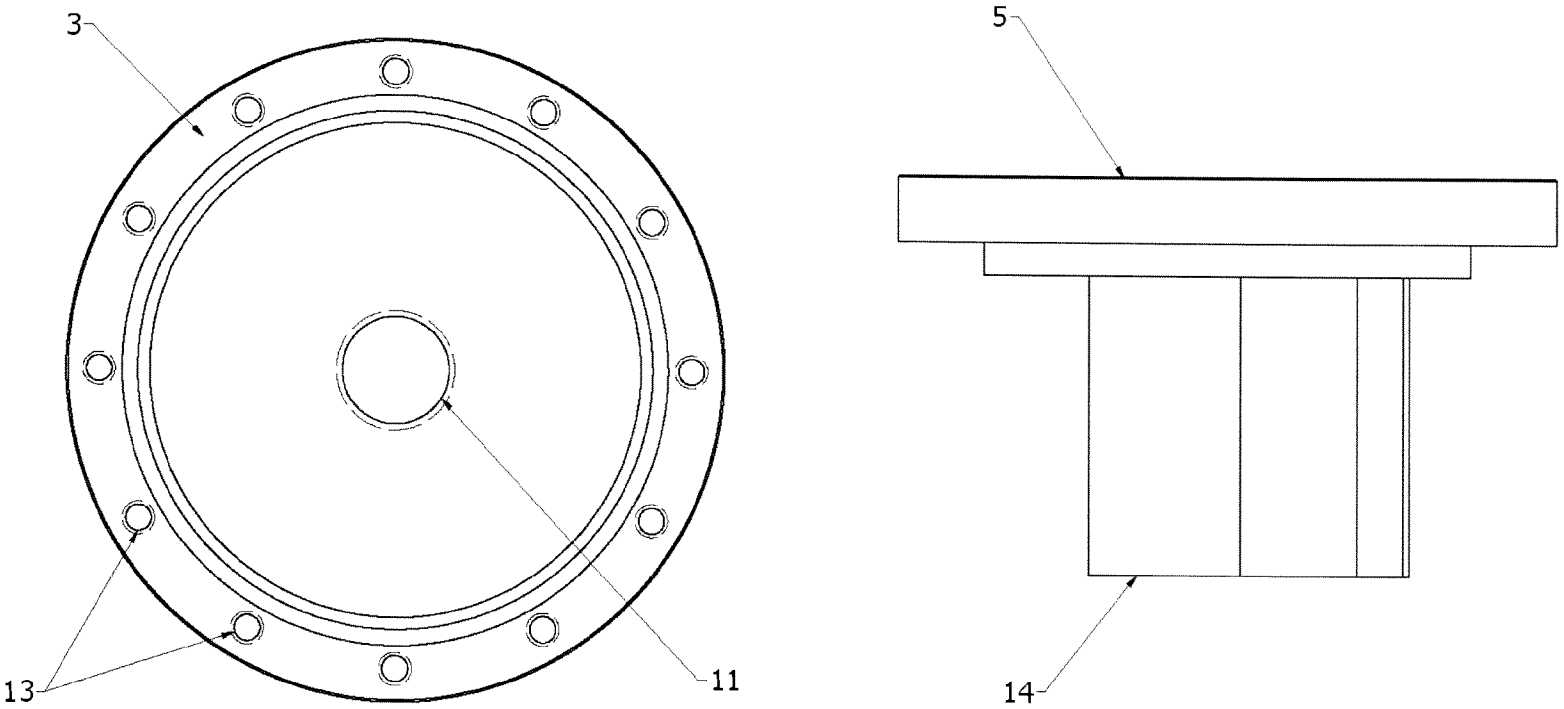
FIG. 1 is a side perspective view of an embodiment of the top cover and the housing of the radiant heating system according to an exemplary embodiment.
Figure 1B:
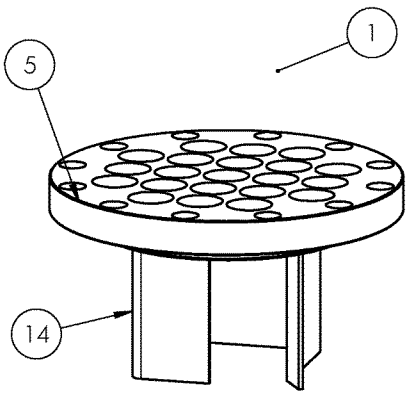
FIG. 1B is a second perspective view of an embodiment of the top cover and the housing of the radiant heating system.
Figure 1A:
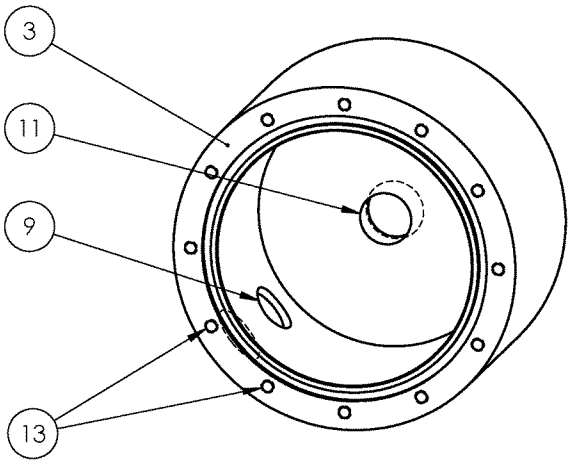
FIG. 1A is first perspective view of an embodiment of the top cover and the housing of the radiant heating system.
Figure 2:
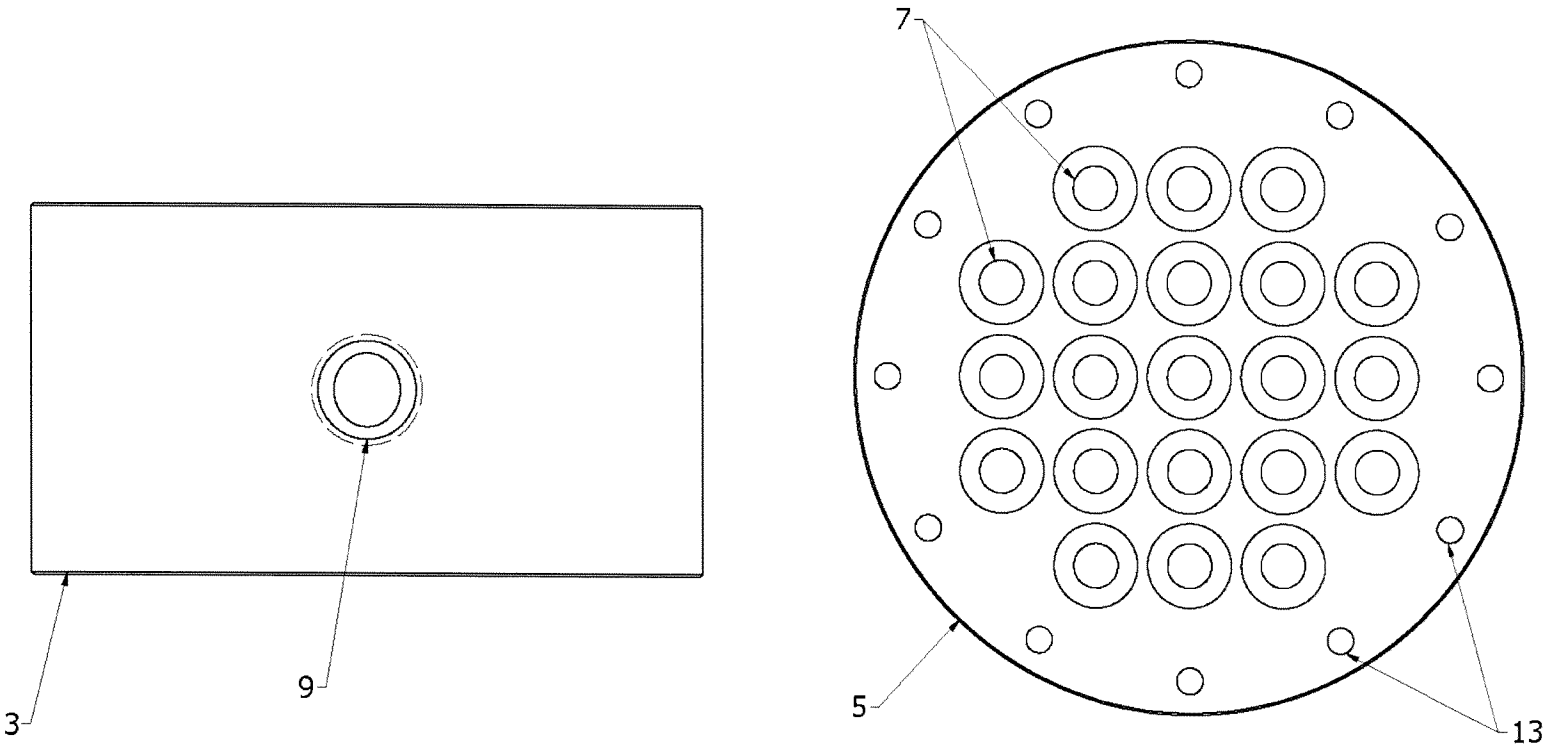
FIG. 2 is a side perspective view of the top cover and the housing of the radiant heating system according to the embodiment of FIG. 1.
Figure 2B:
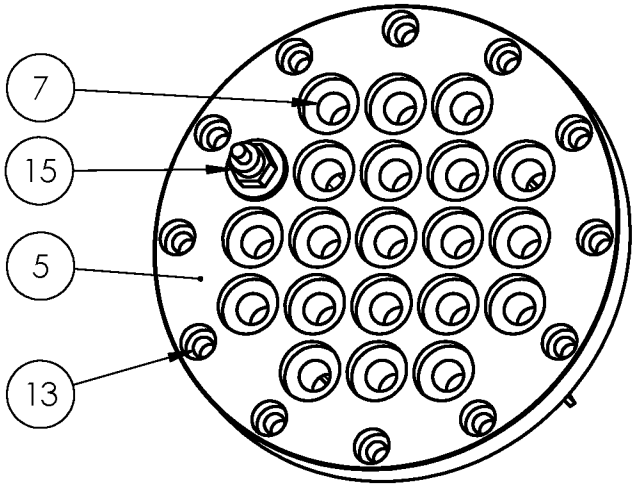
FIG. 2B is a second perspective view of the top cover and the housing of the radiant heating system.
Figure 2A:
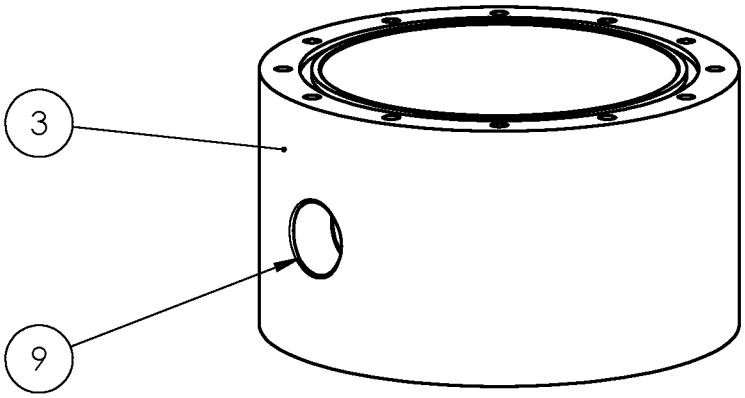
FIG. 2A is a first perspective view of the top cover and the housing of the radiant heating system.
Figure 3:
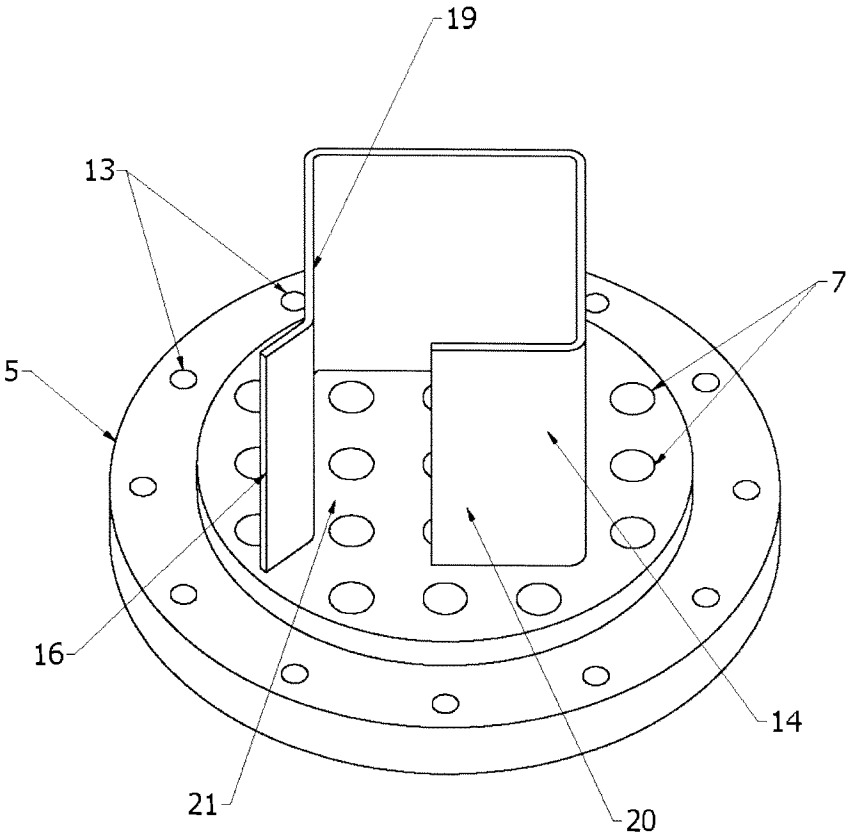
FIG. 3 is a top perspective view of the top cover of the housing for the radiant heating system illustrating the coolant directing enclosure, according to the embodiment of FIG. 1.
Figure 3A:
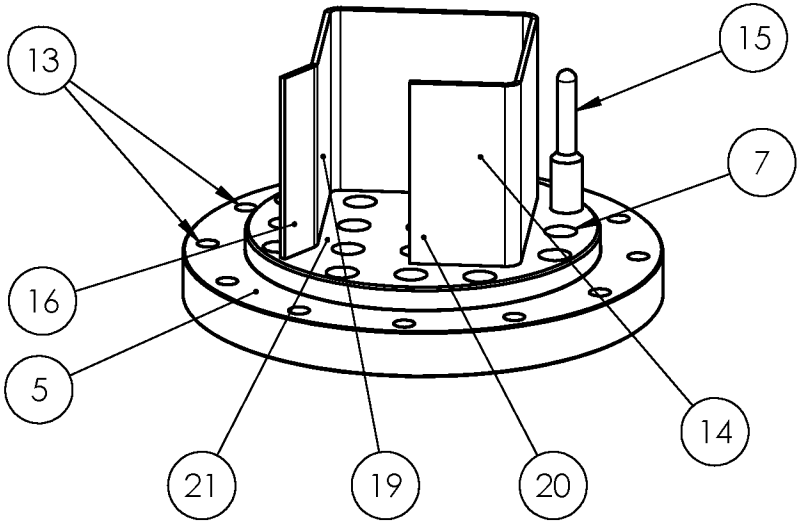
FIG. 3A is a perspective view of the top cover of the housing for the radiant heating system illustrating the coolant directing enclosure.

Referring to FIGS. 1-3, a radiant heating system 1 includes a housing 3 through which coolant (not illustrated) may pass. Preferably, the coolant will be water, though it is conceivable that other fluids could be utilized, as would be apparent to one of ordinary skill in the art. Preferably, the housing 3 is made of metal, such as stainless steel, though it is conceivable that other materials could also be utilized, as would be apparent to one of ordinary skill in the art. The size and shape of the housing can be depending upon the application of the system and the space constraints of the system, as would also be understood by one of ordinary skill in the art. In an exemplary embodiment the housing 3 is substantially hollow and substantially circular.

The housing 3 includes a top cover 5 configured to cover and seal a top surface of the housing 3. The top cover 5 may be coupled to the housing 3, for example, by receiving screws placed through securing holes 13. Any other suitable connecting means may be utilized. The housing 3 includes an inlet 9 configured to allow the coolant to enter the housing 3, and an outlet 11 configured to allow the coolant to exit the housing 3. In addition, the top cover 5 has openings 7 defined therein, configured to allow the insertion of heating elements 15 therein to project into the housing 3 and thus, be in direct contact with the coolant to heat it. Such a heating element 15 is described in U.S. patent application Ser. No. 12/557,682, filed on Sep. 11, 2009, which is incorporated herein by reference in its entirety. The number of heating elements 15 may be varied, depending upon the application of the system and the size required of the system. For example, as few as two heating elements 15 could be used, or up to sixteen or more.

In one embodiment, the housing 3 possesses a coolant directing enclosure 14 positioned on an upper interior surface of the top cover 5 of the housing 3. The coolant directing enclosure 14 is configured to increase the turbulence of the coolant within the housing 3 as it flows through, so as to temporarily inhibit and keep coolant in the housing 3 longer to heat it in a faster and more efficient manner, and increase water pressure in the system. Preferably, the coolant directing enclosure 14 is substantially solid and made of metal. Although in alternative embodiments, portions of the coolant directing enclosure may be hollow or made of other materials, as would be appreciated by one of ordinary skill in the art. Further, in one embodiment, the coolant directing enclosure 14, as shown in FIG. 3, is substantially enclosed on three sides and partially enclosed on a final side 20 to form an opening 21. A length of one side 19 of the coolant directing enclosure 14, bordering the opening 21, has a greater length than the remaining sides of the coolant directing enclosure 14 and the final side 20. Further, an end portion 16 of the final side 20 or the one side 19 of the coolant directing enclosure 14 is flanged outwardly. In this configuration, by virtue of the end portion 16 having a rounded, flamed opening, the turbulence of coolant within the housing 3 is increased, as coolant exits and enters, and swirls within, the coolant directing enclosure 14.

Figure 4:
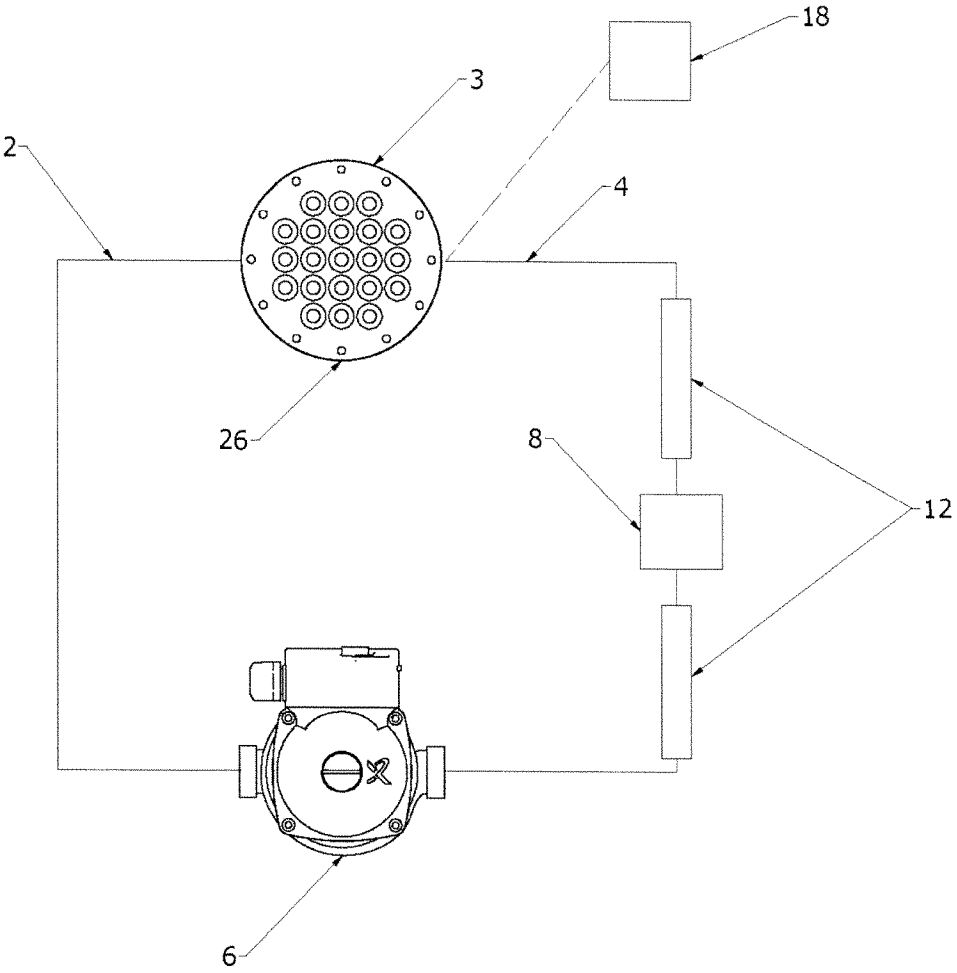
FIG. 4 is a first flow diagram of a radiant heating system and the system components according to an exemplary embodiment.
Figure 4A:
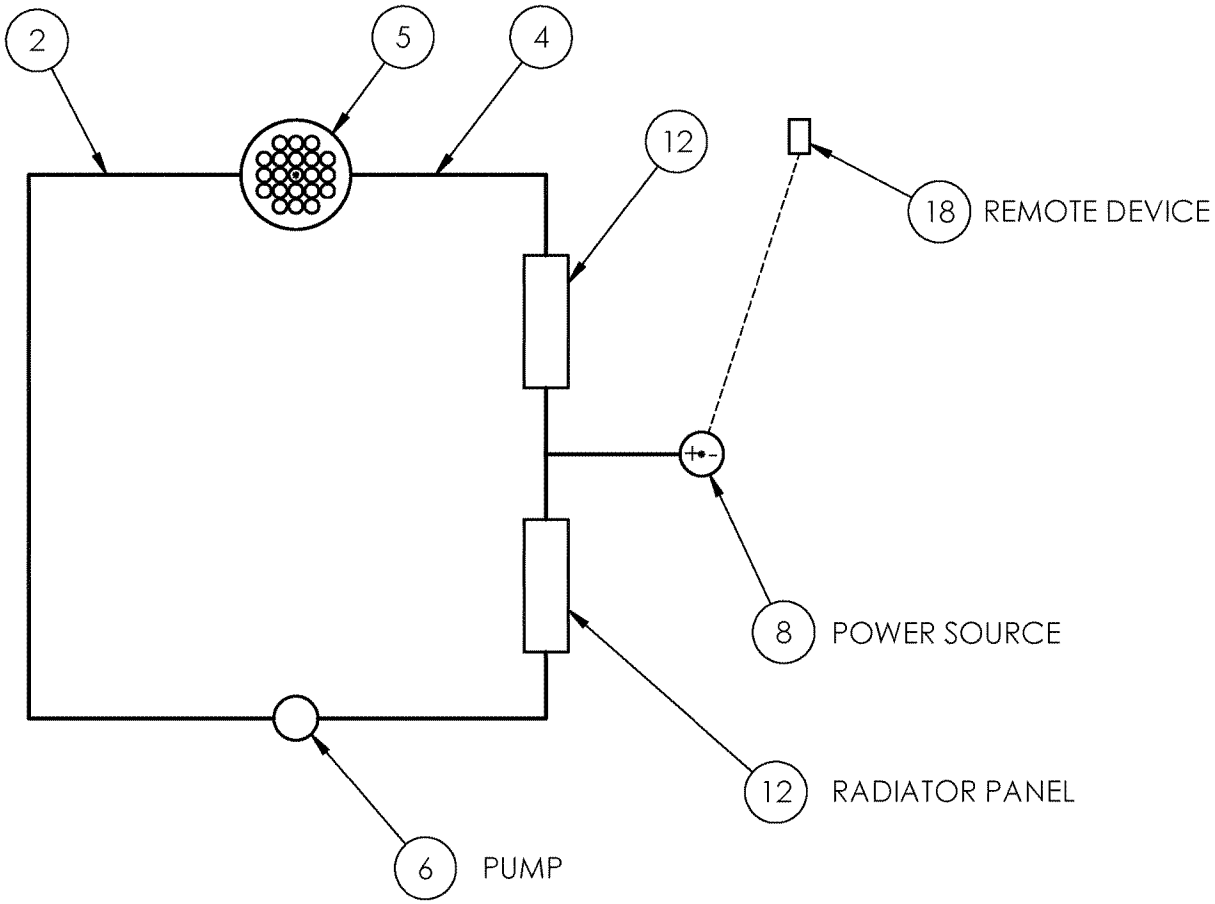
FIG. 4A is a second flow diagram of a radiant heating system and the system components according to an exemplary embodiment.

Referring now to FIG. 4, the inlet 9 and the outlet 11 may be interconnected with piping 2, 4 (see FIG. 4) to form a closed fluid flow circuit. Specifically, the inlet 9 is interconnected with an inlet pipe 2, and the outlet 11 is interconnected with an outlet pipe 4. In an exemplary embodiment, a diameter of the inlet 9 is greater than a diameter of the outlet 11, so as to temporarily inhibit flow and keep coolant in the housing 3 longer to heat the coolant in a faster and more efficient manner. The number of heating elements 15 can be varied, depending upon the application of the system and the size required of the system.

Once the inlet pipe 2 and the outlet pipe 4 are interconnected to the radiant heating system 1, a pump 6 and a power source 8 may be interconnected to the radiant heating system 1 to circulate the coolant in the closed fluid flow circuit and through the radiant heating system 1. Any known pump or power source may be utilized. For example, in one embodiment, the power source can be an electrical type power source or a power pack that can be plugged in by a power cord, though it is conceivable that, alternatively, other types of power sources such as solar power cells, A/C power, DC power pack, battery, wind generated power sources or the like may be utilized, as would be apparent to one of ordinary skill in the art. It will be understood that the power source can be activated conventionally, or, for example, by a remote device (not illustrated), as would be understood by one of ordinary skill in the art.

The coolant is circulated throughout the system by the pump 6. The heating elements 15 are connected to, and supplied with, power from the power source 8 for enabling the heating elements 15 to heat the coolant. An electrical connection portion of heating elements 15 can, as an example, be made of Inconel™, it being understood that this refers to a family of austenitic nickel chromium-based super-alloys, which are typically used in high temperature applications. Common trade names for Inconel™include: Inconel 625™, Chronin 625™, Altemp 625™, Haynes 625™, Nickelvac 625™and Nicrofer 6020™, for example. Preferably, any of the heating elements 15 are easily removable and replaceable if required from the housing 3 without disassembly of the housing or disconnection of the housing from the radiant heating system L Radiator panels 12 may be connected to the closed fluid flow circuit to radiate the heat from the coolant flowing in the circuit to a space to be heated by the radiant heating system 1. Such a space could be, for example, a home, a room, an office, radiant flooring or a building. If desired, such generated heat can be circulated by a conventional fan or blower.

A user may activate the radiant heating system 1 by a remote device 18 from a distance. Specifically, the remote device 18 may be configured to activate the power source 8, which in turn may activate the heating elements 15 and the interconnected system.

The radiant heating system can further comprise a thermostatic control 26 configured to deactivate the heating elements 15 when a temperature of the coolant exceeds a pre-determined level. Further, the thermostatic control 26 may also be configured to turn the heating elements 15 on when a temperature of the coolant falls below a pre-determined level.

In an alternative embodiment, coolant can be omitted and dry heat, provided from the heating elements 15, can be utilized. In this embodiment (not illustrated), the housing 3 preferably includes an air passageway extending therethrough for passage of air through the housing 3. The heating elements 15 are inserted and mounted into the openings 7 and project into the housing 3 such that the heating elements 15 are in direct contact with air in the air passageway. A power source 8 in communication with the radiant heating system 1 is configured to supply the heating elements 15 with power, for enabling the heating elements 15 to heat the air. An air blower, for example, or other such device, is provided to direct the heated air to an area external to the radiant heating system 1, such as a house or other enclosed structure. The air blower is supplied with power from the power source 8. The heated air can then be circulated by a conventional air handler/blower through the ductwork of a home.

It is to be understood that both the foregoing general description and detailed description are exemplary and explanatory only, and are not restrictive of the invention.

For purposes of this disclosure, the term "coupled" means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components or the two components and any additional member being attached to one another. Such joining may be permanent in nature or alternatively may be removable or releasable in nature.

The construction and arrangement of the diffuser as shown in the preferred and other exemplary embodiments is illustrative only. Although only a few embodiments of the present airbag assembly have been described in detail in this disclosure, those skilled in the art who review this disclosure will readily appreciate that many modifications are possible (e.g. variations in sizes, dimensions, structures, shapes and proportions of the various elements, values of parameters, mounting arrangements, use of materials, orientations, etc.) without materially departing from the novel teachings and advantages of the subject matter recited in this disclosure. Accordingly, all such modifications attainable by one versed in the art from the present disclosure within the scope and spirit of the present invention are to be included as further embodiments of the present invention. The order or sequence of any process or method steps may be varied or re-sequenced according to alternative embodiments. Other substitutions, modifications, changes and omissions may be made in the design, operating conditions and arrangement of the preferred and other exemplary embodiments without departing from the spirit of the present application.

What is claimed is:

1. A radiant heating system constructed and arranged for interconnection to a power source for heating a desired area and having a closed fluid flow circuit comprising: a housing comprising:

(a) a top cover for covering and sealing an upper surface of the housing, the top cover having a plurality of openings defined therein and having an inlet for permitting a flow of coolant to enter into the housing and an outlet for permitting a transfer of heated coolant out of the housing, wherein a diameter of the inlet is greater than a diameter of the outlet, the inlet and the outlet being constructed and arranged for connection with an inlet pipe and an outlet pipe, respectively; and (b) a coolant directing enclosure for creating turbulence within the housing, positioned on an upper interior surface of the top cover, the coolant directing enclosure being substantially enclosed on three sides and partially enclosed on a final side to form an opening, a length of one side of the enclosure bordering the opening being of a greater length than remaining sides of the coolant directing enclosure and the final side, and wherein an end portion of the final side or the one side of the enclosure bordering the opening is bent outwardly;

a plurality of heating elements constructed and arranged for insertion into the plurality of openings and projecting into the housing whereby the plurality of heating elements are in direct contact with the coolant, the heating elements being removable without disassembly of the housing, and without disconnection of the housing from the closed fluid flow circuit and wherein at least one of the plurality of heating elements is positioned on the upper interior surface of the top cover outside the coolant directing enclosure, and at least one other of the plurality of heating elements is positioned on the upper interior surface of the top cover within a space defined by the coolant directing enclosure;

a pump in communication with the heating system for continuously circulating the coolant throughout the closed fluid flow circuit, wherein the inlet pipe and the outlet pipe are interconnected to form the closed fluid flow circuit, the interconnected inlet pipe and outlet pipe being constructed and arranged to radiate heat to the desired area by means of the heated coolant flowing therethrough, wherein the housing is substantially circular, and wherein the coolant directing enclosure is substantially square shaped.

2. The radiant heating system of claim 1, wherein the system further comprises a thermostatic control in association with the plurality of heating elements and the coolant in the housing, wherein the thermostatic control is adapted to turn the plurality of heating elements off when a temperature of the coolant exceeds a pre-determined level.

3. The radiant heating system of claim 2, wherein the thermostatic control is adapted to turn the plurality of heating elements on when a temperature of the coolant falls below a pre-determined level.

4. The radiant heating system of claim 1, wherein the plurality of heating elements are DC heating elements.

5. The radiant heating system of claim 1, wherein the system further comprises a remote device for activating, at a distance from the housing, the power source to provide the power to the plurality of heating elements and the pump.

6. The radiant heating system of claim 1, wherein radiator panels can be connected to the closed fluid flow circuit to radiate heat from the heated coolant flowing in the closed fluid flow circuit to heat the desired area.

7. The radiant heating system of claim 1, wherein the coolant directing enclosure is integrally connected to the upper interior surface of the top cover.

8. The radiant heating system of claim 1, wherein the plurality of heating elements are electric heating elements.

9. A housing for use in a radiant heating system constructed and arranged for heating a desired area and haying a closed fluid flow circuit, the housing comprising:

an inlet for permitting a flow of coolant to enter into the housing, the housing being constructed and arranged to circulate the flow of the coolant within the housing;

a plurality of openings defined therein which are constructed and arranged for insertion of a plurality of heating dements into the plurality of openings and projecting into the housing, whereby the plurality of heating elements are in direct contact with the coolant to heat the coolant;

an outlet for permitting a transfer of heated coolant out of the housing, wherein a diameter of the inlet is greater than a diameter of the outlet;

a top cover for covering and sealing an upper surface of the housing, the top cover having a plurality of openings defined therein; and a coolant directing enclosure for creating turbulence within the housing, positioned on an upper interior surface of the top cover, the coolant directing enclosure being substantially enclosed on three sides and partially enclosed on a final side to form an opening, a length of one side of the enclosure bordering the opening being of a greater length than remaining sides of the coolant directing enclosure and the final side, and wherein an end portion of the final side or the one side of the enclosure bordering the opening is bent outwardly, and wherein at least one of the plurality of heating elements is positioned on the upper interior surface of the top cover outside the coolant directing enclosure, and at least one other of the plurality of heating elements is positioned on the upper interior surface of the top cover within a space defined by the coolant directing enclosure;

wherein the inlet and the outlet are constructed and arranged for communication and interconnection with an inlet pipe and an outlet pipe, respectively, for forming the closed fluid flow circuit, the interconnected inlet pipe and outlet pipe being constructed and arranged to radiate heat to the desired area by means of the heated coolant flowing therethrough, wherein the housing is substantially circular, and wherein the coolant directing enclosure is substantially square shaped.

* * * * *